United States Patent [19]

Alger et al.

[11] Patent Number: 4,907,703

[45] Date of Patent: Mar. 13, 1990

[54] OFFICE DESK STORAGE SYSTEM

[75] Inventors: Andrew L. Alger, Wilmette; Marlan H. Polhemus, Chicago; Albert B. Cheris, Glencoe; Richard L. Gibson, Glen Ellyn, all of Ill.

[73] Assignee: Tenex Corporation, Elk Grove, Ill.

[21] Appl. No.: 201,543

[22] Filed: Jun. 2, 1988

Related U.S. Application Data

[62] Division of Ser. No. 896,867, Aug. 15, 1986, abandoned.

[51] Int. Cl.[4] ..... B42F 17/00

[52] U.S. Cl. ..... 211/10; 211/126

[58] Field of Search ..... 211/10, 11, 126, 128, 211/13, 194; 220/23.4, 23.6; 206/506, 509, 510, 511, 512

[56] References Cited

U.S. PATENT DOCUMENTS

| | | | |
|---|---|---|---|
| 56,104 | 7/1866 | Schmidt . | |
| 426,542 | 4/1890 | Munger . | |
| 986,395 | 3/1911 | King . | |
| 1,951,972 | 3/1934 | Fraser | 211/126 |
| 2,123,257 | 7/1938 | Provost . | |
| 2,873,861 | 2/1959 | Jensen | 211/126 |
| 3,141,554 | 7/1964 | Sussman et al. | 211/126 |
| 3,968,881 | 7/1976 | Beil et al. | 211/128 |
| 4,074,810 | 2/1978 | Juergens et al. | 211/126 X |
| 4,253,402 | 3/1981 | Carrig et al. | 211/126 X |
| 4,353,470 | 10/1982 | Polhemus et al. | 211/126 |
| 4,657,148 | 4/1987 | Heng | 211/128 |

FOREIGN PATENT DOCUMENTS

| | | |
|---|---|---|
| 2224070 | 5/1972 | Fed. Rep. of Germany . |
| 1453638 | 8/1966 | France . |
| 1016 | of 1870 | United Kingdom . |
| 314321 | 6/1929 | United Kingdom . |

*Primary Examiner*—Alvin C. Chin-Shue
*Assistant Examiner*—Sarah A. Lechok
*Attorney, Agent, or Firm*—Niro, Scavone, Haller & Niro, Ltd.

[57] ABSTRACT

A desk storage system for efficiently organizing various office implements using modular components assembled in one of a plurality of configurations according to user preference. The desk storage system includes modular components attachable to one another by connectors mounted on the periphery of the modular components. The connectors enable lateral and, selectively, angular tilt adjustment of adjacent modular components. A strong, rigid shelf is also provided for supporting the modular components, while also allowing the lateral and angular tilt adjustment of the modular components. The system further includes stacked trays selectively adjustable relative to one another. The trays are stacked using stacking brackets readily engageable between paper trays, while providing a strong, rigid connection.

1 Claim, 8 Drawing Sheets

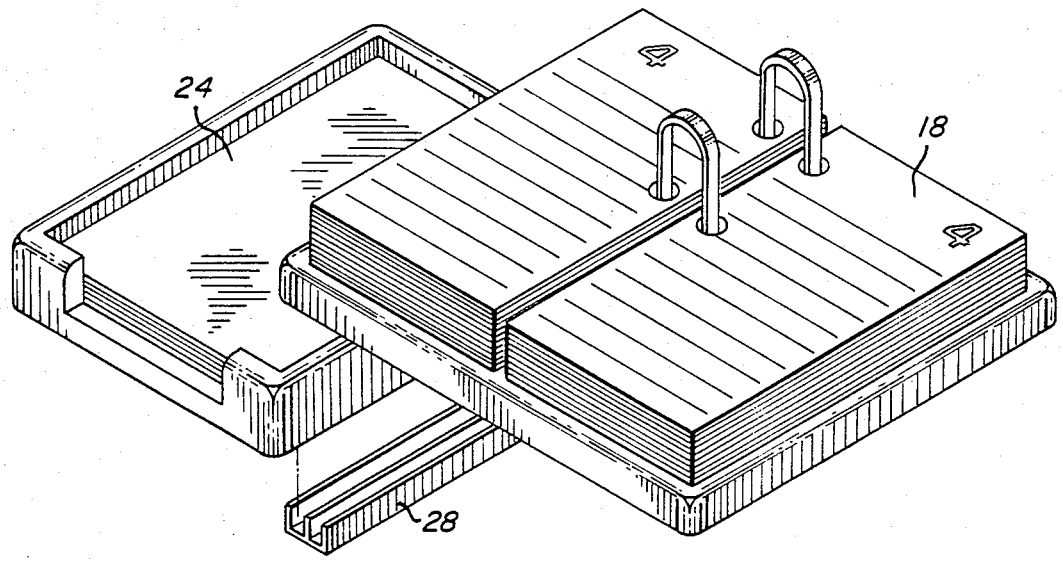
FIG. 1B
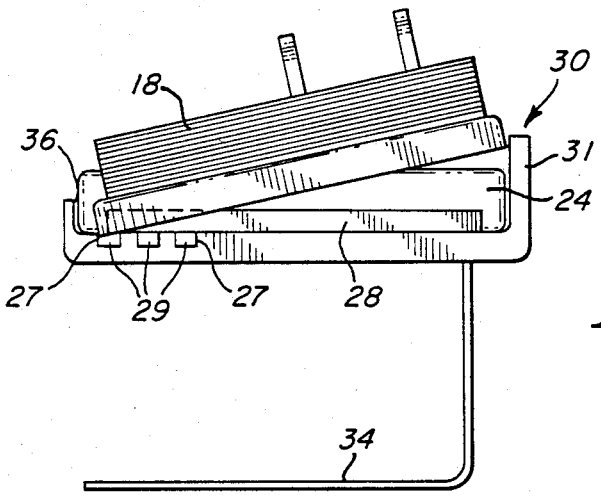
FIG. 2B
FIG. 2C
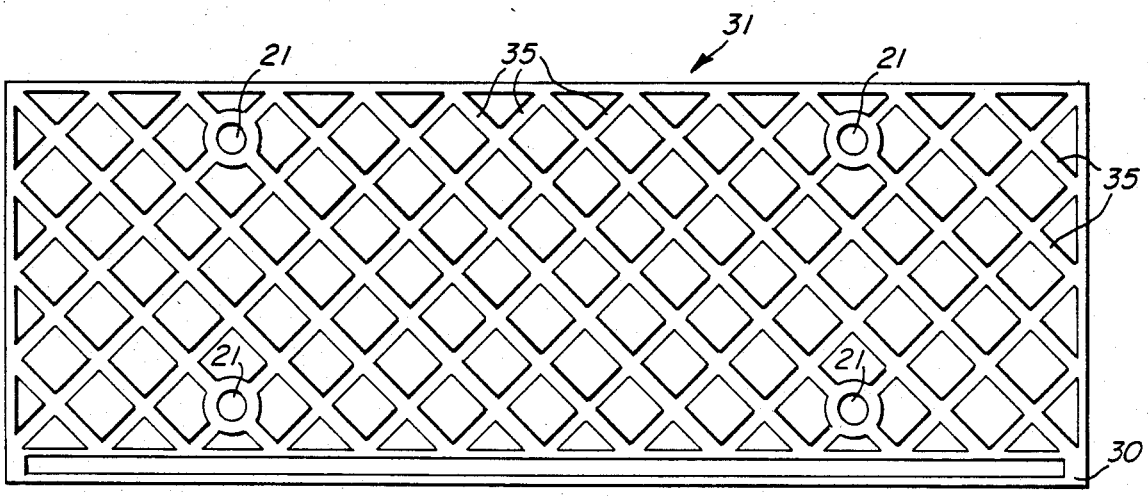

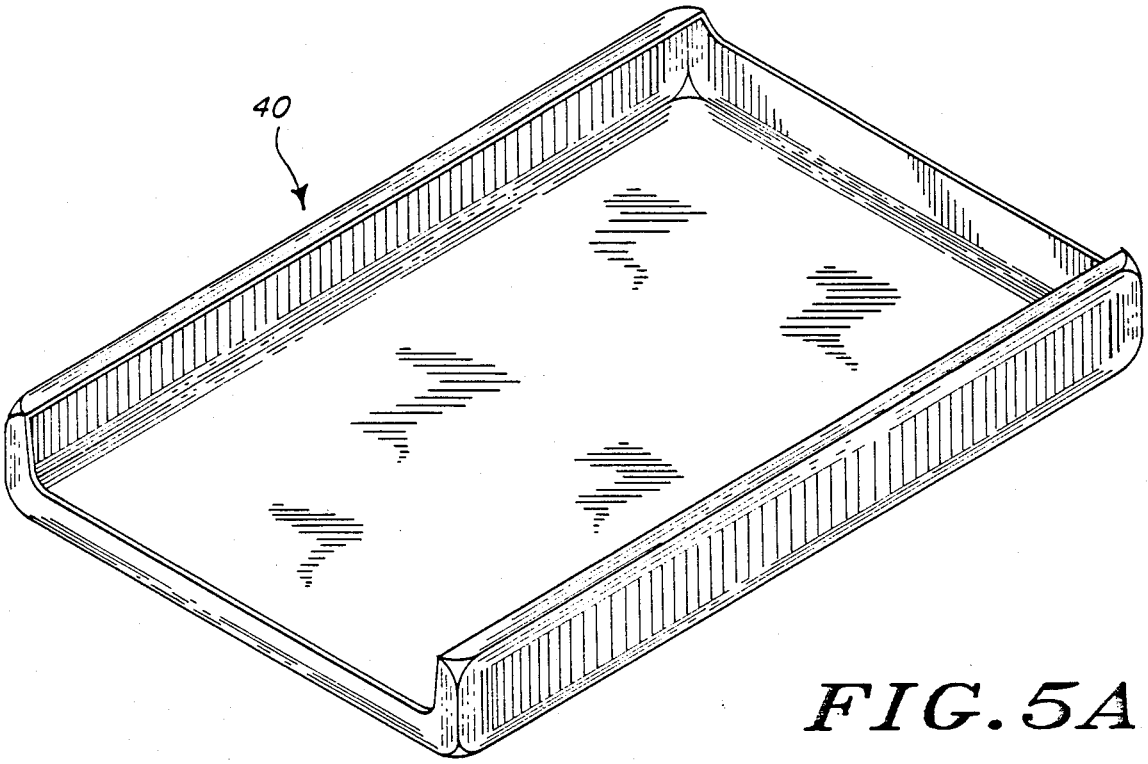
FIG. 5A
FIG. 5B
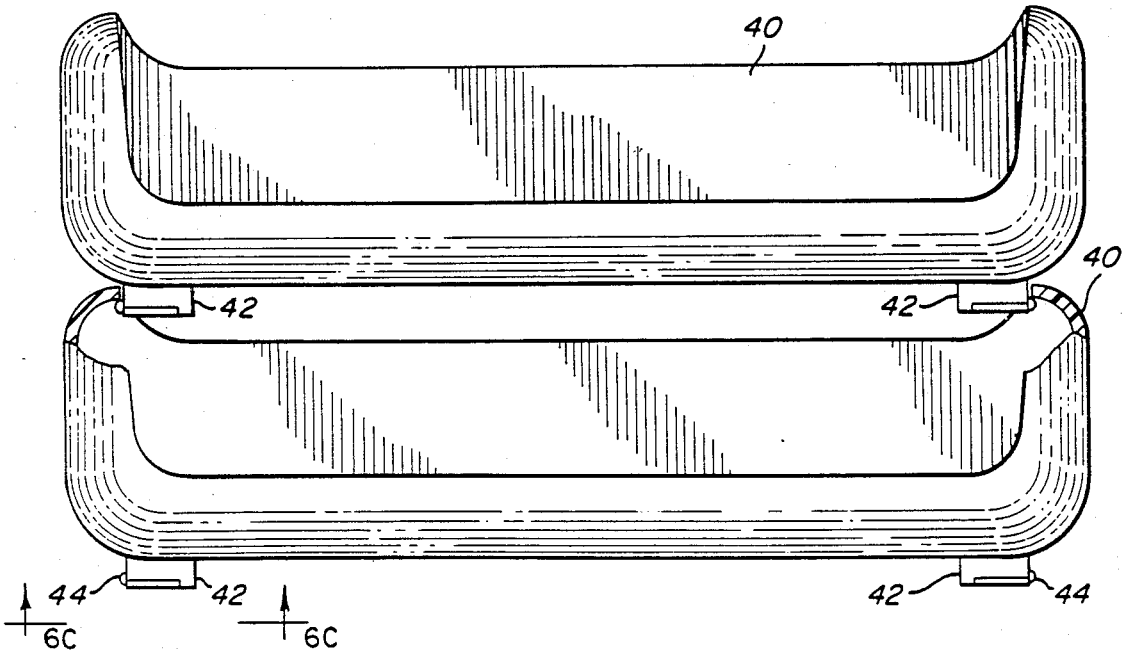

OFFICE DESK STORAGE SYSTEM

This is a divisional of co-pending application Ser. No. 896,867 filed on Aug. 15, 1986, now abandoned.

BACKGROUND OF THE INVENTION

The present invention relates generally to an office desk storage system for organizing and arranging a plurality of office implements of a user. More particularly, the invention relates to a modular component desk storage system having connecting pieces which enable construction of a plurality of arrangements and relative positional adjustment of selected modular components.

Previous desk storage systems have provided a user with only a few basic arrangements of components or with systems enabling little or no freedom to change the basic storage arrangement. Other systems have provided a fixed, relatively large basic structure with a number of storage sections for office implements and also with selected portions of the basic structure adaptable for different purposes. There have also been provided tray storage systems having a plurality of vertically stackable storage trays joined by bayonet connectors which are difficult to install and remove. More recently, fixed basic structures have been adapted to allow enlargement of storage facilities through the stacking of new portions on the basic structure. Most of these previous systems, in addition to having very little flexibility of use, tend to have rather high profiles, dominating a substantial portion of a desk area where located and presenting a cluttered appearance to the desk.

BRIEF SUMMARY OF THE INVENTION

One of the primary objects of the present invention is to provide an improved office desk storage system.

It is another object of the invention to provide a novel desk storage system having modular components for assembly into a user selected system.

It is a further object of the invention to provide an improved desk storage system including connectors for joining modular elements and for adjustably positioning the modular elements relative to one another.

It is an additional object of the invention to provide a novel desk storage system having a shelf adapted for adjustably sliding modular components of the system and in selected instances for tilting the system components.

It is another object of the invention to provide an improved desk storage system having a shelf adapted for supporting user work implements, as well as adjustably positioning modular components of the system.

A feature of the desk storage system in accordance with the invention lies in the provision of modular container components adapted for holding office implements, and the user is able to use these modular components to construct a plurality of configurations for the system. The modular components are attachable to one another by connectors which mount on the peripheral edges of the modular container components. These connectors also enable adjustable positioning of adjacent containers, including sliding and in some instances tilting relative to one another. The various containers are also supportable by a shelf which includes a plurality of grooves for holding office implements. The structure of the shelf also enables angular tilt and lateral position adjustment of selected ones of the modular container components. Paper trays are also stackable and adjustably positionable to provide the user the optimum desired arrangement.

Further objects and advantages of the present invention, together with the organization and manner of operation thereof will become apparent from the following detailed description of the invention when taken in conjunction with the accompanying drawings, wherein like reference numerals designate like elements throughout the several views.

BRIEF DESCRIPTION OF THE DRAWINGS

FIG. 1B shows an exploded view of two components and the connector;

FIG. 2B is a transverse end view from the right end of the shelf in FIG. 2A; FIG. 2C is a bottom view of the shelf.

FIG. 5A shows a perspective view of a paper tray; FIG. 5B shows a front view of two stacked paper trays of the type shown in FIG. 5A, and also shown are position adjustment brackets on the trays with a cutaway section showing detail on connection of the trays.

DESCRIPTION OF PREFERRED EMBODIMENTS

Figure 1A:
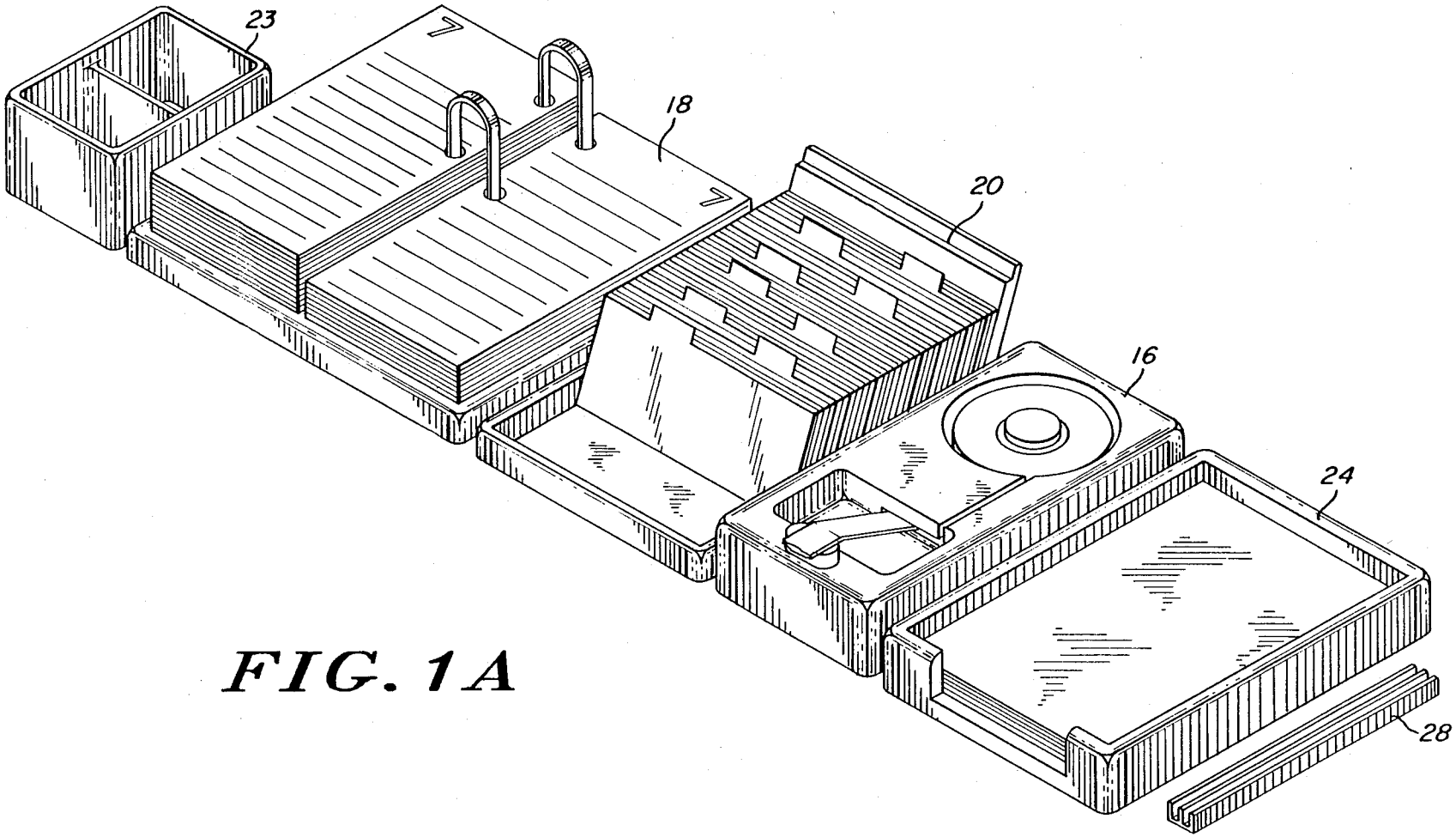
FIG. 1A shows various modular container components and a connector for the components.
Figure 2A:
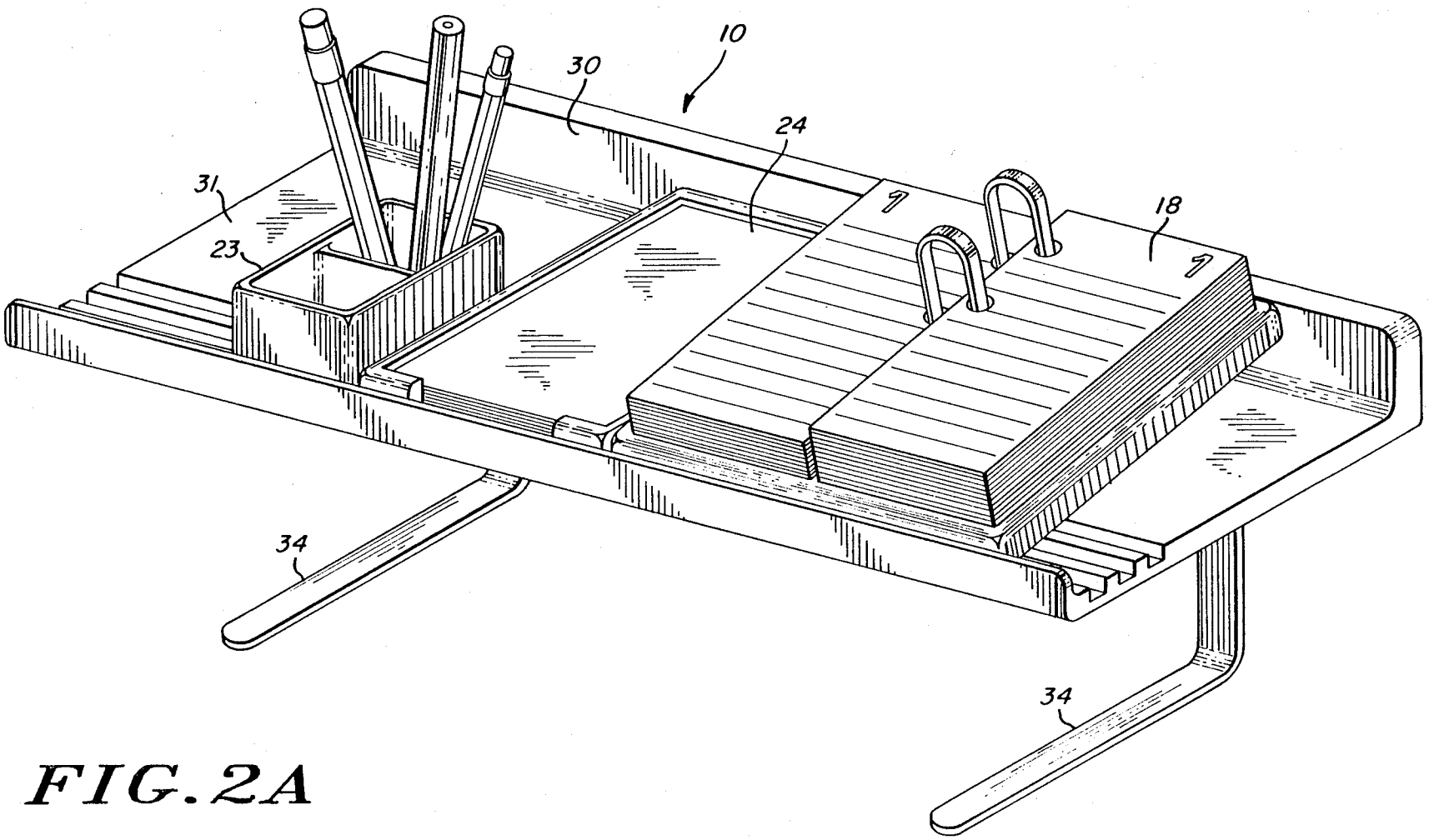
FIG. 2A illustrates a self supported shelf with two connected modular container components with one component tilted.
Figure 2D:
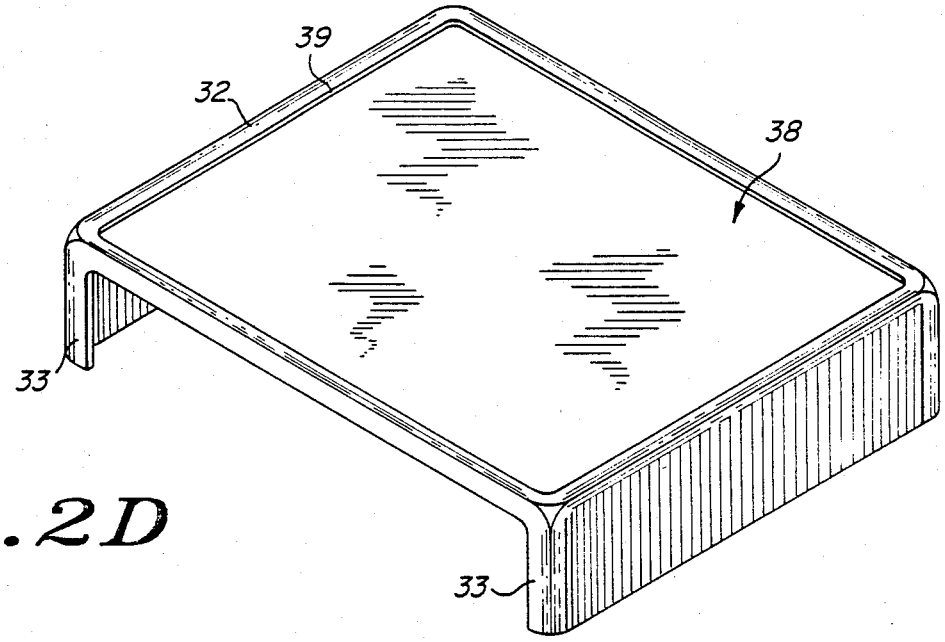
FIG. 2D is a perspective view of a stacking platform.
Figure 3:
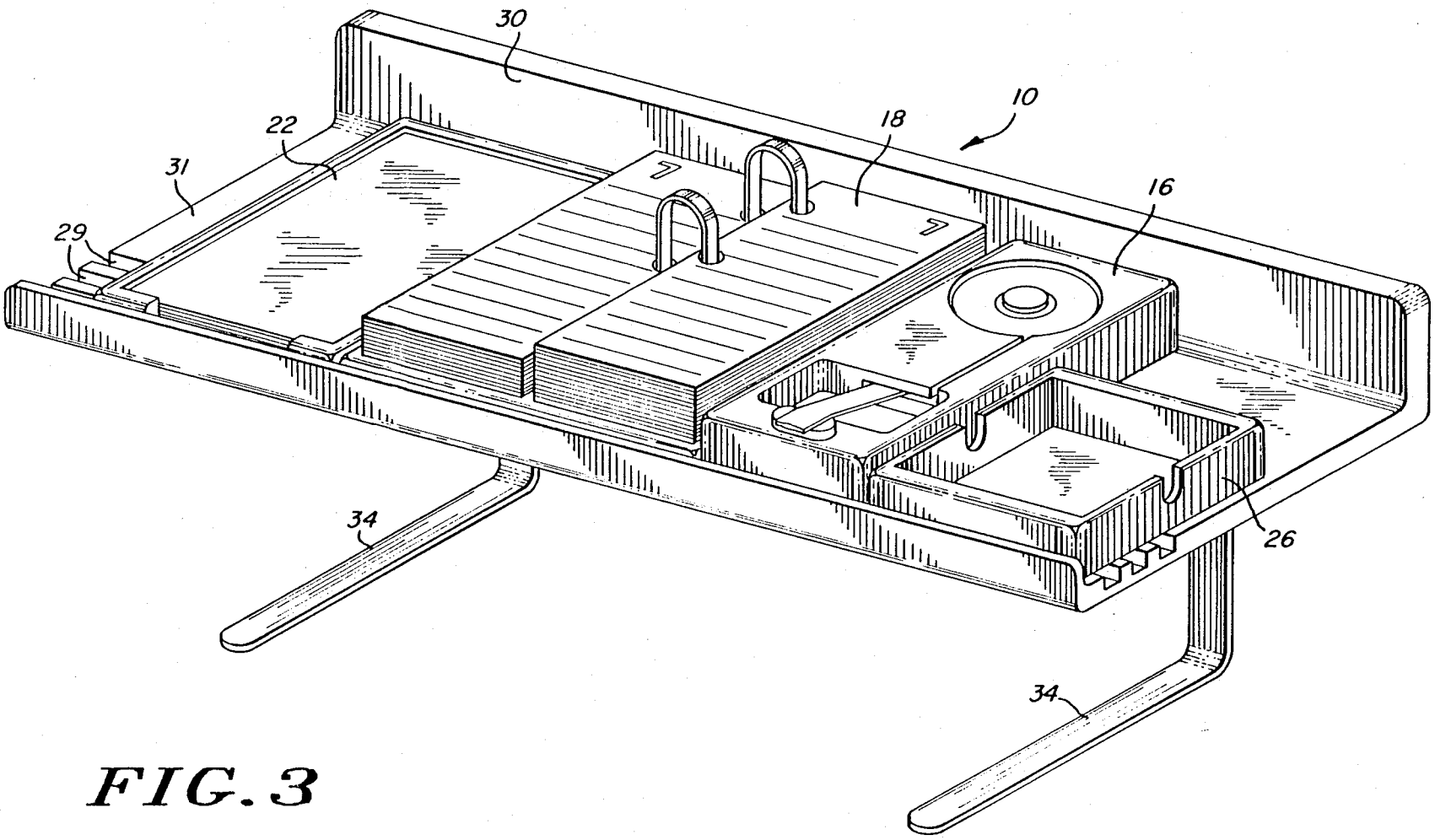
FIG. 3 shows several of the modular components and selected user implements positioned flat on a shelf elevated on support feet structural brackets.

Referring now to the drawings and in particular to FIGS. 2A and 3, an office desk storage system constructed in accordance with one embodiment of the invention is generally indicated at 10. The office desk storage system 10 (hereinafter, "storage system 10") enables the user to conveniently organize a plurality of particular office implements, such as pencils, pens, erasers, paper clips, note pads, calendars, tape and card files. The storage system 10 includes container means for holding each of the plurality of particular office implements, with each of the container means having a modular construction adapted for the user to construct a desired arrangement from among a plurality of selectable configurations. Examples shown in FIGS. 1–4 of the container means include various modular container components, such as, a paper clip holder 14, a tape dispenser 16, a calendar holder 18, a card file 20, a memo holder 22, a pencil cup 23, a note pad holder 24 and an ashtray 26.

The storage system 10 further includes means for connecting each of the modular container components to one another. The connecting means is, for example, joiner clips 28 shown as one of the components alone in FIG. 1A and also shown in FIG. 1B positioned for connecting the note pad holder 24 to the calendar holder 18. The joiner clip 28 has a slotted shape adapted to fit over the peripheral sides of the various modular container components. The joiner clip 28 has two slotted portions coupled together to enable positioning the selected modular container components immediately adjacent one another in the manner shown in FIGS. 1B and 2A, 2B and 3. The joiner clip 28 can be constructed in a variety of lengths suitable for connecting different ones of the various modular container components.

As can be seen in FIGS. 1B and 2B, the particular geometry for the joiner clips 28 includes means for adjusting the position of adjacent ones of the modular container components. These relative positional adjustement features arise from the depth and overall length of the slotted portion of the joiner clip 28. The positional adjustment of the modular container components can, for example, be a simple lateral displacement and/or can be an angular tilt relative to one another if support means (discussed hereinbelow) is provided under the elevated portion of the component. As shown in FIGS. 1B and 2B, using the joiner clip 28, a combination of lateral displacement and angular tilt can be provided to the calendar holder 18 relative to the note pad holder 24.

The stability of the positionally adjusted modular container components is generally insured by the depth and length of the slotted portion of the joiner clips 28. In addition, further stability is provided, particularly in the case of angular tilt adjustment, by using the previously discussed support means, such as a support stop, for positioning elongated ones of the modular container components against the selected support stop. An example of the support stop can be seen from examining FIGS. 2A and B, wherein the bottom edge of the calendar holder 18 can be positioned against the support stop, such as, for example, vertical edges 27 of grooves 29 and a back inside wall 30 of a shelf 31.

If the user wishes to conserve desk top space, means for supporting the storage system 10 is utilized. Examples of the supporting means comprise the shelf 31 shown in FIGS. 2A and 3 and a stacking platform 32 shown in FIG. 2D. The shelf 31 is constructed to accommodate various ones of the modular container components, such as, for example, the memo holder 22, the calendar holder 18 and the tape dispenser 16, which are shown disposed on the shelf 31 in FIG. 3.

The shelf 31 is also shown elevated to make available desk top space below the shelf 31. This is accomplishable by using structural brackets, such as, for example, support feet 34 connected to the shelf 31 by fasteners (such as screws) at fastening points 21 shown in FIG. 2C. The support feed 34 are preferably constructed of a material having slip resistant contact properties, such as rubber bottoms 25 shown in FIG. 2B. This slip resistant property prevents slipping of the shelf 31 on the desk surface, providing good positional stability while under use and preventing movement of the shelf 31 if bumped accidently. Other structual brackets can comprise suspension means, such as upward extending wall brackets or support cables (not shown), for elevating the shelf 31 above a desk top. The illustrated shelf 31 is also constructed to give high strength and rigidity by using support members of relatively thick plastic ribbing as shown in FIG. 2C, and the support feet 34 are made of relatively heavy gauge steel (for example, $\frac{1}{8}$ in. structural steel). The resulting shelf 31 has such strength and rigidity that it can be used to support large, heavy books, as well as the various modular components.

As mentioned hereinbefore, the shelf 31 also includes structural features, such as the vertical edges 27 and the back inside wall 30, which enable the user to adjustably position the angle and lateral position of the modular components relative to one another. As shown in FIGS. 1B and 2B, the calendar holder 18 is tilted and laterally displaced relative to the note pad holder 24. The relative range of lateral displacement and angular tilt is determined by the joiner clips 28 (in the manner discussed hereinbefore) and also by the amount of space available between the back wall 30 and a front inside wall 36 of the shelf 31. As discussed previously, the degree of angular tilt is also determined by the positioning of the front edge of the selected modular container component relative to the vertical edges 27 of one of the plurality of the grooves 29, or relative to the front inside wall 36. Consequently, the dimensions of the vertical edges 27, the number and size of the grooves 29 and the distance between the front wall 36 and the back wall 30 can be constructed to accomplish various ranges of tilt for the modular container components.

Figure 4:
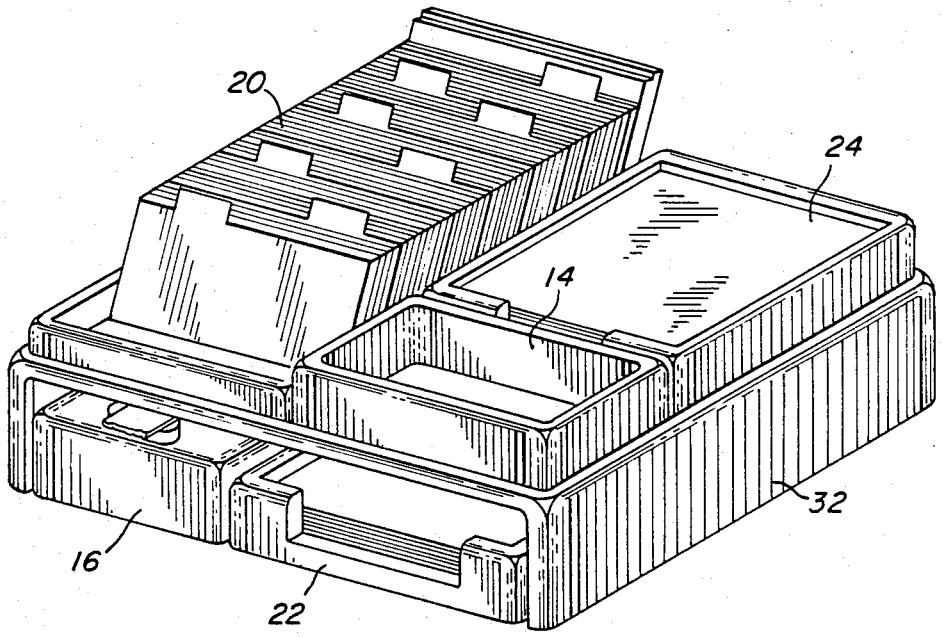
FIG. 4 is an exploded view including the stacking platform of FIG. 2D with a tape dispenser and note pad holder disposed below the platform and other components positionable on the top of the platform.

Another possible supporting means is the stacking platform 32 shown in FIG. 2D which is open in the front and has upstanding sides 37 on three sides. These sides 37 are of sufficient height to enable placement under the top of the stacking platform 32 of selected ones of the modular container components, such as the tape dispenser 16 and the memo holder 22, as shown in FIG. 4. The free top surface of the stacking platform 32 has a recessed portion 38 delineated by recess edges 39. The recessed portion 38 also provides space for various selected ones of the modular container components, such as, for example, the card file 20, the paper clip holder 14 and the note pad holder 24. The recess edges 39 conveniently restrict movement of the components placed in the recessed portion 38.

Figure 5C:
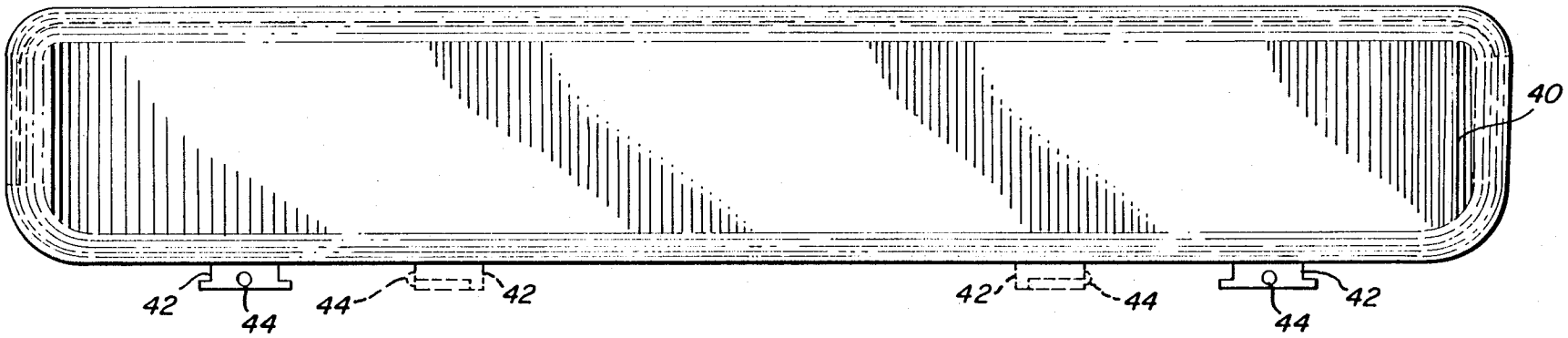
FIG. 5C shows a side view of the paper tray and adjustment brackets with a second set of adjustment brackets in phantom for position adjustment of two trays oriented perpendicular to one another.

Another aspect of the invention is the lateral and even transverse, or perpendicular, adjustability of paper trays 40 shown in FIG. 5B. The paper trays 40 can be of legal size or letter size, or a mixture of different size trays. The ability to adjust laterally or transversely positioned trays in a shingled or tiered arrangement arises from tray adjustment means, such as adjustment brackets 42 shown in FIGS. 5B and 5C. The adjustment brackets 42 are shown cast as an integral part of each of the trays 40. In another form of the invention the adjustment brackets 42 can be attached by fastener means, such as bolts or screws (not shown). The adjustment brackets 42 have a protrusion, such as, for example, a peak 44, which together with the bottom surface of the trays 40 immediately above the peak 44, define a channel 46 which engages with a tray peripheral edge 48, permitting relative movement of the coupled trays 40. By appropriate positioning of the adjustment brackets 42, the range of adjustement, typically lateral movement, is definable.

In another form of the invention the trays 40 can be adapted for adjustability of two or more trays oriented perpendicular to one another. This is accomplished by turning by 90° the adjustment brackets 42 (or by having another set of adjustment brackets 49 turned 90° relative to the brackets 42, as shown in phantom in FIG. 5C), thereby allowing transverse, or perpendicular, engagement of the trays 40. This is useful, for example, in more sophisticated space planning or in preparing tray arrangements complementary to a particular spatial arrangement for the remainder of the components.

Figure 6C:
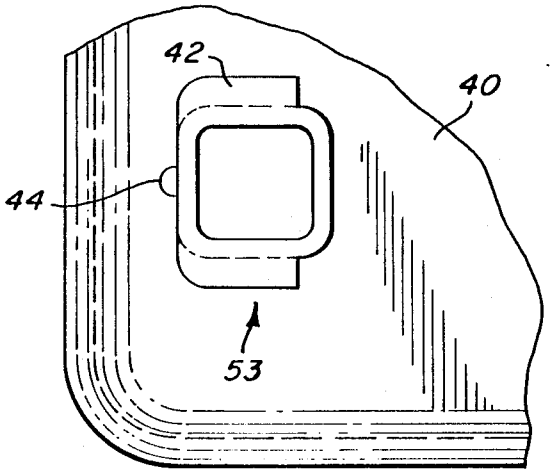
FIG. 6C is a fragmentary bottom view taken along line 6C—6C in FIG. 5B of a corner of a stacking tray, showing details of an adjustment bracket.
Figure 6B:
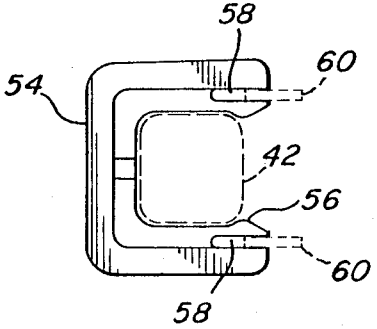
FIG. 6B is a top view of the stacking bracket taken along line 6B—6B in FIG. 6A.
Figure 6A:
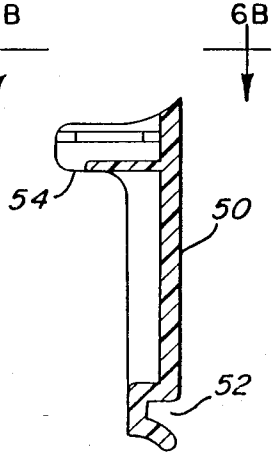
FIG. 6A shows a side view of a stacking bracket.
Figure 6D:
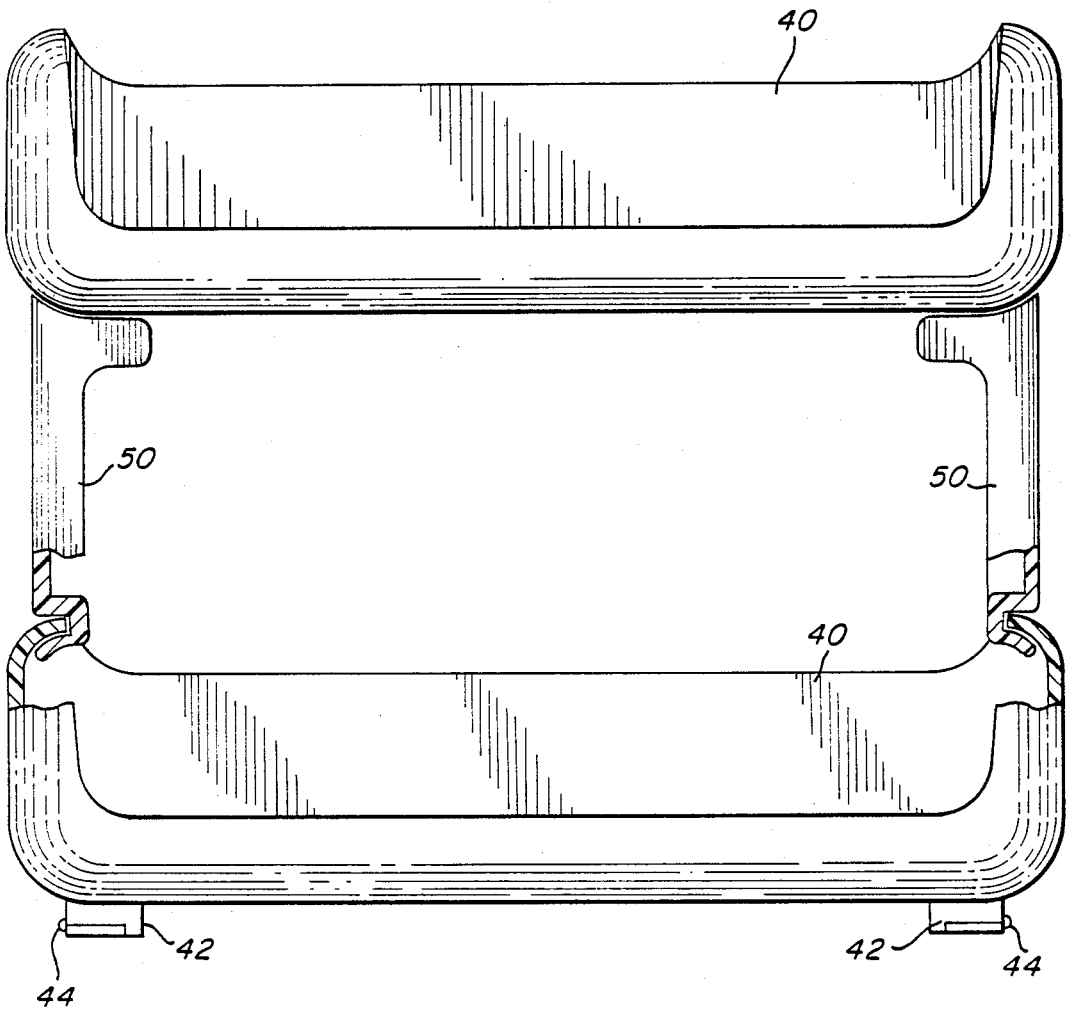
FIG. 6D is a front view and partial cutaway of two paper trays stacked using stacking brackets.

Another feature of the invention is the use of a versatile stacking bracket 50 shown in FIG. 6A and D which enables the stacking of the paper trays 40. The bottom clip portion 52 couples easily to the edge 48 (see FIG. 5B) of the paper tray 40 and also enables longitudinal adjustment of the paper trays 40 relative to one another. Also included is a top portion 54 engageable along direction 53 (see FIG. 6C) with the adjustment bracket 42 as shown in FIG. 6C and D. The top portion 54 includes flexible snap clips 56 (see FIG. 6B) which snap over the ends of the adjustment bracket 42 and bracket channels 58 accept retention elements 60 (shown in FIGS. 5C and 6C and in phantom in FIG. 6B). The retention elements 60 are affixed to the bottom of the paper tray 40 and positioned to engage with the top portion 54 to provide further support for the snap clips 56, thereby forming a rigid, strong coupling which is also readily detachable by the user.

Thus, in accordance with the present invention, an office desk storage system is provided which has a large degree of adjustability, enabling the user of modular components to construct a variety of configurations to best suit the user's needs. Connectors joining the modular components enable the lateral adjustment, and in selected instances the angular tilt adjustment of adjacent ones of the components. The various modular components can be supported on a shelf or platform, enabling the efficient use of desk space. As part of the desk storage system, paper trays can be stacked and the paper tray openings adjusted relative to one another. The stacking brackets allow easy assembly of stacked paper trays while permitting lateral adjustment relative to one another and exhibiting substantial strength and rigidity.

While preferred embodiments of the present invention have been illustrated and described, it will be understood that changes and modifications may be made therein without departing from the invention in its broader aspects. Various features of the invention are defined in the following claims.

What is claimed is:

1. An adjustable paper tray system for selectively adjusting the relative vertical and horizontal spacing between trays, comprising:

a plurality of couplable and stackable trays with a bottom surface and top edges;

adjustment brackets secured to the bottom of said trays, wherein each of said adjustment brackets includes a protruding element that, together with the bottom surface of said trays, forms a channel for slidably engaging said top edges of a first one of said trays in close vertical proximity with the bottom surface of a second tray above said first tray; and stacking brackets for spacing said trays substantially more vertically distant than with said adjustment brackets, said stacking brackets comprising a bottom clip portion slidably adapted to couple with the top edge of said trays, an elongated post portion, and a top portion adapted to engage said adjustment bracket, said top portion including flexible snap clips securable around said adjustment brackets by retention elements that slide into channels between said top portion and said flexible snap clips.

* * * * *